US008152559B1

(12) United States Patent
Montena

(10) Patent No.: US 8,152,559 B1
(45) Date of Patent: Apr. 10, 2012

(54) SPLIT COMPRESSION MID-SPAN GROUND CLAMP

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 13/076,886

(22) Filed: Mar. 31, 2011

(51) Int. Cl.
*H01R 4/24* (2006.01)

(52) U.S. Cl. ..... 439/394; 439/775; 174/78

(58) Field of Classification Search ..... 439/394, 439/775, 578; 174/75, 78
See application file for complete search history.

(56) References Cited

U.S. PATENT DOCUMENTS

| | | | | | |
|---|---|---|---|---|---|
| 3,233,035 | A | | 2/1966 | Black | |
| 3,989,340 | A | | 11/1976 | Sheldon et al. | |
| 4,178,054 | A | * | 12/1979 | Laudig | 439/394 |
| 4,341,922 | A | | 7/1982 | Bossard et al. | |
| 4,515,991 | A | | 5/1985 | Hutchison | |
| 4,538,021 | A | | 8/1985 | Williamson, Jr. | |
| 4,872,626 | A | | 10/1989 | Lienart | |
| 4,885,432 | A | | 12/1989 | Amoyal et al. | |
| 4,933,512 | A | | 6/1990 | Nimiya et al. | |
| 5,271,080 | A | | 12/1993 | Hopper et al. | |
| 5,362,251 | A | * | 11/1994 | Bielak | 439/394 |
| 5,444,810 | A | | 8/1995 | Szegda | |
| 5,498,839 | A | | 3/1996 | Behrendt et al. | |
| 5,594,212 | A | | 1/1997 | Nourry et al. | |
| 5,607,320 | A | * | 3/1997 | Wright | 439/394 |
| 5,685,072 | A | * | 11/1997 | Wright | 29/866 |
| 5,691,505 | A | | 11/1997 | Norris | |
| 5,695,357 | A | * | 12/1997 | Wright | 439/394 |
| 5,722,841 | A | | 3/1998 | Wright | |
| 5,883,333 | A | | 3/1999 | Wambeke et al. | |
| 6,011,218 | A | | 1/2000 | Burek et al. | |
| 6,537,104 | B1 | | 3/2003 | Hagmann et al. | |
| 6,607,399 | B2 | * | 8/2003 | Endo et al. | 439/578 |
| 6,808,415 | B1 | | 10/2004 | Montena | |
| 6,809,265 | B1 | | 10/2004 | Gladd et al. | |
| 6,910,899 | B1 | | 6/2005 | Daume | |
| 7,005,582 | B2 | | 2/2006 | Muller et al. | |
| 7,081,016 | B2 | * | 7/2006 | Tateno | 439/585 |
| 7,121,872 | B1 | * | 10/2006 | Hanks | 439/427 |
| 7,414,198 | B2 | * | 8/2008 | Stansbie et al. | 174/74 R |
| 8,052,490 | B2 | * | 11/2011 | Bernasch et al. | 439/775 |
| 2001/0049224 | A1 | * | 12/2001 | Togashi et al. | 439/578 |
| 2003/0085051 | A1 | * | 5/2003 | Daume | 174/75 C |
| 2003/0089517 | A1 | | 5/2003 | Takahashi et al. | |
| 2006/0281348 | A1 | | 12/2006 | Burris et al. | |
| 2007/0137877 | A1 | | 6/2007 | Stansbie et al. | |

* cited by examiner

*Primary Examiner* — Tulsidas C Patel
*Assistant Examiner* — Vladimir Imas
(74) *Attorney, Agent, or Firm* — Schmeiser Olsen & Watts

(57) ABSTRACT

A grounding clamp positioned on a coaxial cable at a location other than an end of the coaxial cable, wherein the grounding clamp includes an outer shell formed by the unity of a first split shell portion and a second split shell portion, the outer shell having a radial relationship with an elastomeric sleeve, the elastomeric sleeve being radially disposed over a conductive bonding contact, the conductive bonding contact being radially disposed over an outer conductive portion of the coaxial cable, wherein axial compression of a first split driver and a second split driver against the ends of the grounding clamp facilitates electrical contact between the outer shell and the conductive bonding contact and between the conductive bonding contact and the outer conductive portion of the coaxial cable. Furthermore, an associated method for maintaining ground continuity is also provided.

18 Claims, 5 Drawing Sheets

SPLIT COMPRESSION MID-SPAN GROUND CLAMP

FIELD OF TECHNOLOGY

The following relates to grounding clamps used in coaxial cable communication applications, and more specifically to embodiments of a split compression mid-span grounding clamp fitted around a portion of a prepared coaxial cable.

BACKGROUND

Broadband communications have become an increasingly prevalent form of electromagnetic information exchange and coaxial cables are common conduits for transmission of broadband communications. Coaxial cables are typically designed so that an electromagnetic field carrying communications signals exists only in the space between inner and outer coaxial conductors of the cables. This allows coaxial cable runs to be installed next to metal objects without the power losses that occur in other transmission lines, and provides protection of the communications signals from external electromagnetic interference. Grounding clamps are provided at mid-span locations to establish electrically ground connections at mid-span locations. Grounding at midpoint locations divert lightning strike currents that may travel along the cable to the tower or other cabling specifically installed to handle high current and/or high voltage. However, in the field, grounding clamps located at mid-span locations on coaxial cables sometimes invite corrosion and environmental pollutants to enter the inner components of the coaxial cable and disrupt the electrical continuity between the coaxial cable and the grounding clamp.

Hence, a need exists for an improved mid-span grounding clamp that both seals the components from environmental pollutants and also ensures adequate electrical grounding connections at mid-span locations.

SUMMARY

A first general aspect of the invention provides a split compression mid-span coaxial cable grounding clamp device comprising an outer shell, having a first end and an opposing second end, the outer shell including a first split shell portion and a second split shell portion, the first split shell portion and the second split shell portion securely joinable to form the complete outer shell, wherein at least a portion of the outer shell is conductive, an elastomeric sleeve, sized for coaxial insertion within the outer shell between the first end and the second end, the elastomeric sleeve configured to substantially surround a prepared portion of a coaxial cable, a conductive bonding contact, sized for coaxial insertion within the elastomeric sleeve and having a conductive bridge member structured to make electrical contact with the outer shell, when the conductive bonding contact is disposed within the outer shell, a first split compression driver, having two split portions that are joinable to form the complete first split compression driver; and a second split compression driver, having two split portions that are joinable to form the complete second split compression driver, wherein, when the first split compression driver is compressed into the first end of the outer shell and the second split compression driver is compressed into second end of the outer shell, the elastomeric sleeve is compressed moving the conductive bonding contact into contact with an outer conductor of the prepared coaxial cable when the cable is disposed within the grounding clamp device, and the first split compression driver and the second split compression driver form annular seals around an outer jacket of the coaxial cable at the first and second ends of the outer shell, thereby effectively sealing the grounding clamp device to the coaxial cable.

A second general aspect of the invention provides a grounding clamp comprising a first shell portion disposed over an elastomeric sleeve, the elastomeric sleeve having a slit extending therethrough, a second shell portion disposed over the elastomeric sleeve, wherein the first shell portion and second shell portion securably join to form an outer shell, the outer shell having a first end, an opposing second end, and a first inner annular opening positioned proximate the first end and a second inner annular opening positioned proximate the second end of the outer shell, a conductive member surrounded by the elastomeric sleeve, the conductive member surrounding an exposed outer conductive portion of a coaxial cable, a first split compression driver moveably attached to the first end of the outer shell, and a second split compression driver moveably attached to the second end of the outer shell, wherein tightening of the first shell portion to the second shell portion and axial compression of the first split compression driver and the second split compression driver drives the conductive member into contact with the exposed outer conductive portion of the coaxial cable to facilitate an adequate electrical grounding connection, and forms annular seals around the coaxial cable.

A third general aspect of the invention provides a device comprising a grounding clamp positioned on a coaxial cable at a location other than an end of the coaxial cable, wherein the grounding clamp includes an outer shell formed by the unity of a first split shell portion and a second split shell portion, the outer shell having a radial relationship with an elastomeric sleeve, the elastomeric sleeve being radially disposed over a conductive bonding contact, the conductive bonding contact being radially disposed over an outer conductive portion of the coaxial cable, wherein axial compression of a first split driver and a second split driver against the ends of the grounding clamp facilitates electrical contact between the outer shell and the conductive bonding contact and between the conductive bonding contact and the outer conductive portion of the coaxial cable.

A fourth general aspect of the invention provides a method for maintaining ground continuity through a coaxial cable comprising providing a grounding clamp comprising an outer shell, having a first end and an opposing second end, the outer shell including a first split shell portion and a second split shell portion, the first split shell portion and the second split shell portion securely joinable to form the complete outer shell, wherein at least a portion of the outer shell is conductive, an elastomeric sleeve, sized for coaxial insertion within the outer shell between the first end and the second end, the elastomeric sleeve configured to substantially surround a prepared portion of a coaxial cable, a conductive bonding contact, sized for coaxial insertion within the elastomeric sleeve and having a conductive bridge member structured to make electrical contact with the outer shell, when the conductive bonding contact is disposed within the outer shell, a first split compression driver, having two split portions that are joinable to form the complete first split compression driver, and a second split compression driver, having two split portions that are joinable to form the complete second split compression driver, and axially compressing the first split compression driver into the first end of the outer shell and the second split compression driver into second end of the outer shell, wherein the axial compression of the first split compression driver and the second split compression driver compresses the elastomeric sleeve, moving the conductive bonding contact into contact with an outer conductor of the prepared coaxial cable when the cable is disposed within the grounding clamp device.

The foregoing and other features of construction and operation of the invention will be more readily understood and fully appreciated from the following detailed disclosure, taken in conjunction with accompanying drawings.

BRIEF DESCRIPTION OF THE DRAWINGS

Some of the embodiments of this invention will be described in detail, with reference to the following figures, wherein like designations denote like members, wherein.

DETAILED DESCRIPTION

Although certain embodiments of the present invention are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a", "an" and "the" include plural referents, unless the context clearly dictates otherwise.

Figure 1:
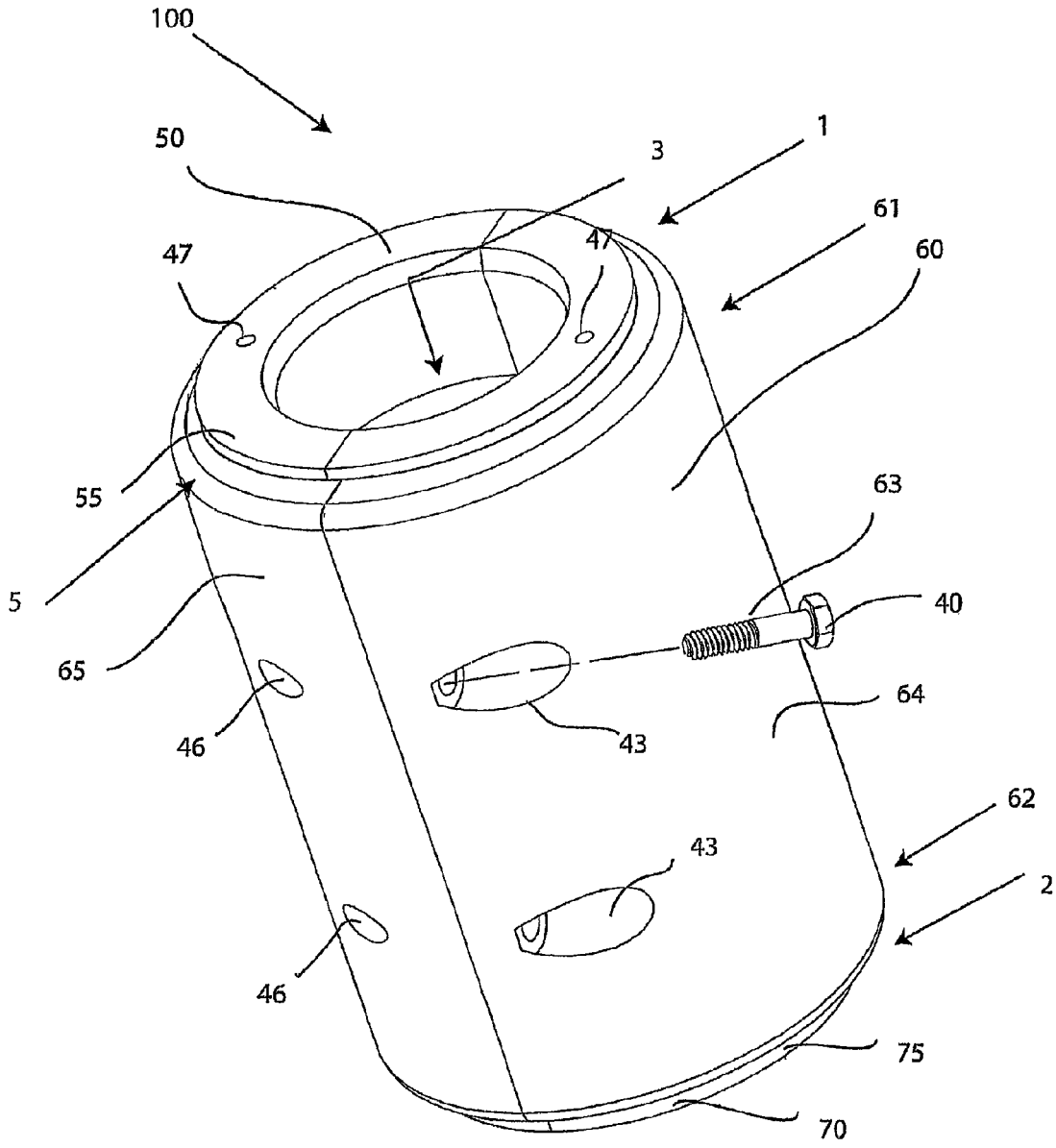
FIG. 1 depicts a perspective view of a first embodiment of a grounding clamp in an open position.

Referring to the drawings, FIG. 1 depicts one embodiment of a grounding clamp 100 in an open position 5. The grounding clamp 100 may be operably affixed to a coaxial cable 10 so that the grounding clamp 100 is securely attached to the cable 10. The coaxial cable 10 may include a protective outer jacket 12, a conductive grounding shield 14, a dielectric foil layer 15, an interior dielectric 16 and a center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation. It should be noted that the various materials of which all the various components of the coaxial cable 10 are comprised should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive grounding shield 14, dielectric foil layer 15, interior dielectric 16 and/or center conductor 18 may vary based upon generally recognized parameters corresponding to broadband communication standards and/or equipment.

Figure 2A:
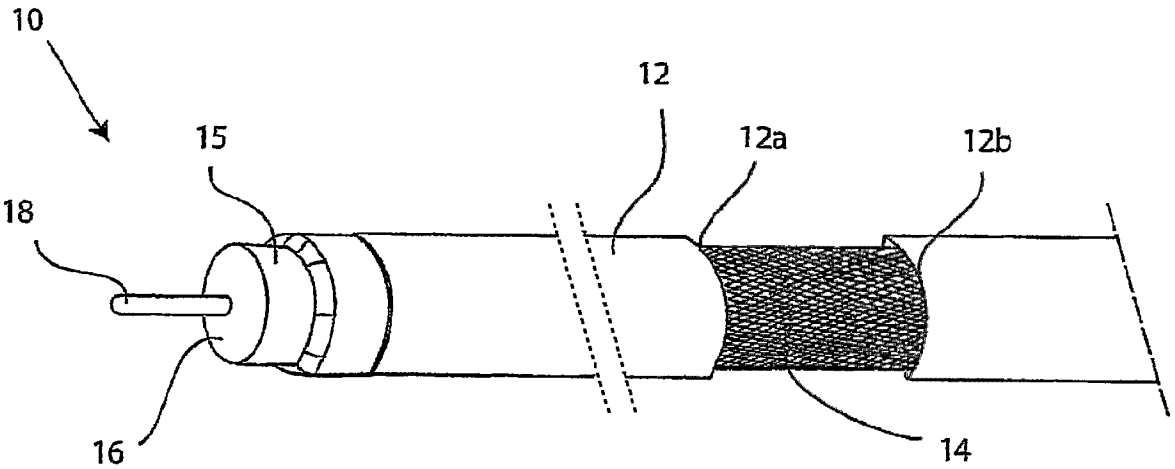
FIG. 2A depicts a perspective view of a first embodiment of a prepared coaxial cable.
Figure 2B:
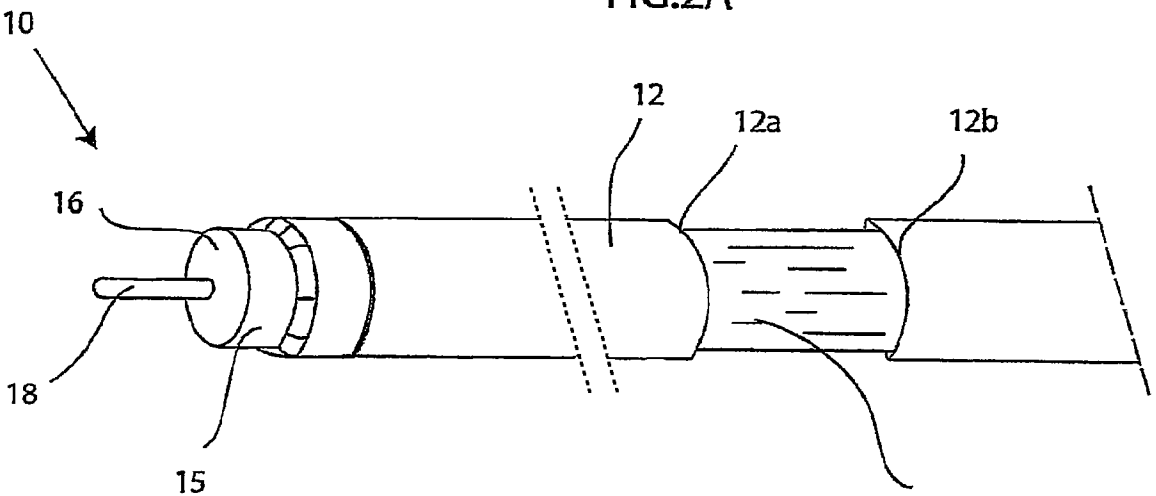
FIG. 2B depicts a perspective view of a second embodiment of a prepared coaxial cable.

The coaxial cable 10 may be prepared as embodied in FIG. 2A and FIG. 2B by removing a portion of the protective outer jacket 12 to expose a conductive portion of the coaxial cable 10. In one embodiment, removing a portion of the outer jacket 12 exposes a portion of the conductive grounding shield 14 at some point along the coaxial cable 10. In an alternative embodiment, a portion of the outer jacket 12 may be removed and a portion of the conductive grounding shield 14 may be removed to expose a portion of the dielectric foil layer 15 surrounding the interior dielectric 16. The removal of the outer jacket 12 may include stripping off a section of the outer jacket 12. For example, a section or portion of the outer jacket 12 may be completely removed, stripped, extracted, cut away, cut out, etc., such that an outer conductive portion of the coaxial cable 10, such as the conductive grounding shield 14, is exposed. In most embodiments, an annular section of the outer jacket 12 is removed, exposing an annular outer surface of a conductive portion of the coaxial cable 10. The outer conductive portion of the coaxial cable 10 may be, inter alia, a solid smooth-wall tubing or a solid corrugated tubing. Removing a portion of the outer jacket 12 can create a break in the outer jacket 12, defined by two outer jacket edges 12*a*, 12*b*. Outer jacket edge 12*a* is separated from outer jacket edge 12*b* by a section of conductive portion of the coaxial cable 10, the conductive portion of the grounding cable being recessed a distance substantially equal to the thickness of the outer jacket 12. Furthermore, at one or both ends, the coaxial cable 10 may be prepared by drawing back a portion of the outer jacket 12 and grounding shield to expose a portion of the dielectric foil layer 15 surrounding the dielectric 16 and the center conductor 18 for operable attachment to a coaxial cable connector.

Referring back to FIG. 1, the grounding clamp 100 is configured to attach to a coaxial cable 10 at a mid-span location. A mid-span location should not be limited to a midpoint of a coaxial cable 10; a mid-span location may be any location along the coaxial cable 10 that is a distance away from either end of the cable 10. There may be more than one grounding clamp 100 located at various points along the cable 10 to facilitate adequate grounding of the cable 10 at a location other than the ends. Before or after the ends of a coaxial cable 10 are lashed to a tower, such as a cell tower, one or more grounding clamps 100 can be positioned around the cable 10 at an approximate final or desired location, such that the cable 10 is disposed within the grounding clamp 100 through the inner diameter pathway 3. In many embodiments, the grounding clamp 100 is positioned around the cable 10 at an approximate final or desired position prior to removing a portion of the outer jacket 12 the coaxial cable 10. An approximate final or desired position simply means that the grounding clamp 100 is proximate or otherwise near the exact final location. Once the grounding clamp 100 is positioned around the cable 10 into an approximate final or desired position, the coaxial cable 10 may be prepared by removing a portion of the outer jacket 12 to expose an outer conductive portion of the coaxial cable 10. Alternatively, the grounding clamp 100 may be completely or substantially preassembled before positioning on the cable 10. For example, the preassembled grounding clamp 100 may be slid along the cable 10 into a final position where the mid span grounding is to occur. In one embodiment, the grounding clamp 100 may be slid, placed, positioned, wrapped, etc., over the break in the outer jacket 12 until internal surface features 26*a*, 26*b*, such as annular detents, ridges, bumps, lips, etc. catch outer jacket edges 12*a*, 12*b*, respectively. The interaction between the internal surface features 26*a*, 26*b* and the outer jacket edges 12*a*, 12*b* may prevent or substantially hinder axial movement of the grounding clamp 100 along the cable 10. The grounding clamp 100 may be secured to the cable 10 by a compression mechanism, which compresses the grounding clamp 100 to effectively seal and secure the grounding clamp 100 to the cable 10. The compression mechanism may include a tightening or fastening means and axial compression means. In many embodiments, the tightening or fastening means involves at least one fastening member 40, which draws a first split shell portion 63 and a second split shell portion 65 tight to prevent the ingress of environmental pollutants and facilitate a secure grounding path between the outer conductive portion of the cable 10 and a conductive connector such as a grounding lug. In most embodiments, the axial compression means involves a compression tool providing axial compression to grounding clamp 100 to compress the multiple components of grounding clamp 100.

Referring still to FIG. 1, an embodiment of a grounding clamp 100 having a first end 1, an opposing second 2, and an inner diameter pathway 3 is now described. The grounding clamp 100 includes an outer shell 60, an elastomeric sleeve 20, a conductive bonding contact 30, a first split compression driver 50, and a second split compression driver 70. In another embodiment, the split compression mid-span coaxial cable grounding clamp 100 may comprise an outer shell 60, having a first end 61 and an opposing second end 62, the outer shell 60 including a first split shell portion 63 and a second split shell portion 65, the first split shell portion 63 and the second split shell portion 65 securely joinable to form the complete outer shell 60, wherein at least a portion of the outer shell 60 is conductive, an elastomeric sleeve 20, sized for coaxial insertion within the outer shell 60 between the first end 61 and the second end 62, the elastomeric sleeve 20 configured to encircle or substantially surround a prepared portion of a coaxial cable 10, a conductive bonding contact 30, sized for coaxial insertion within the elastomeric sleeve 20 and having a conductive bridge member 35 structured to make electrical contact with the outer shell 60, when the conductive bonding contact 30 is disposed within the outer shell 60, a first split compression driver 50, having two split portions that are joinable to form the complete first split compression driver 50, and a second split compression driver 70, having two split portions that are joinable to form the complete second split compression driver 70; wherein, when the first split compression driver 50 is compressed into the first end 61 of the outer shell 60 and the second split compression driver 70 is compressed into second end 62 of the outer shell 60, the elastomeric sleeve 20 is compressed moving the conductive bonding contact 30 into contact with an outer conductor of the prepared coaxial cable 10 when the cable 10 is disposed within the grounding clamp device 100, and the first split compression driver 50 and the second split compression driver 70 form annular seals around an outer jacket 12 of the coaxial cable 10 at the first and second ends 61, 62 of the outer shell 60, thereby effectively sealing the grounding clamp device to the coaxial cable. In another embodiment, grounding clamp 100 may comprise a first shell portion 63 disposed over an elastomeric sleeve 20, the elastomeric sleeve 20 having a slit 25 extending therethrough, a second shell portion 65 disposed over the elastomeric sleeve 20, wherein the first shell portion 63 and second shell portion 65 securably join to form an outer shell 60, the outer shell 60 having a first end 61, an opposing second end 62, and a first inner annular opening 69*a*, 69*c* positioned proximate the first end 61 and a second inner annular opening 69*b*, 69*d* positioned proximate the second end 62 of the outer shell 60, a conductive member 30 surrounded by the elastomeric sleeve 20, the conductive member 30 surrounding an exposed outer conductive portion of a coaxial cable 10, a first split compression driver 50 moveably attached to the first end 61 of the outer shell 60, and a second split compression driver 70 moveably attached to the second end 62 of the outer shell 60, wherein tightening of the first shell portion 63 to the second shell portion 65 and axial compression of the first split compression driver 50 and the second split compression driver 70 drives the conductive member 30 into contact with the exposed outer conductive portion of the coaxial cable 10 to facilitate an adequate electrical grounding connection, and forms annular seals around the coaxial cable 10. In yet another embodiment, a grounding clamp 100 positioned on a coaxial cable 10 at a location other than an end of the coaxial cable 10, wherein the grounding clamp 100 includes an outer shell 60 formed by the unity of a first split shell portion 63 and a second split shell portion 65, the outer shell 60 having a radial relationship with an elastomeric sleeve 20, the elastomeric sleeve 20 being radially disposed over a conductive bonding contact 30, the conductive bonding contact 30 being radially disposed over an outer conductive portion of the coaxial cable 10, wherein axial compression of a first split driver 50 and a second split driver 70 against the ends 1, 2 of the grounding clamp 100 facilitates electrical contact between the outer shell 60 and the conductive bonding contact 30 and between the conductive bonding contact 30 and the outer conductive portion of the coaxial cable 10.

With continued reference to FIG. 1, the outer shell 60 of embodiments of a conductive grounding clamp 100 has a first end 61 and opposing second end 62. The outer shell 60 includes a generally axial opening, and can house, encompass, cover, sheath, or be radially disposed over, the coaxial cable 10, conductive bonding contact 30, elastomeric sleeve 20, and a portion of the first and second split compression drivers 50, 70. Outer shell 60 may also be a housing, enclosure, covering, structure, frame, body, and the like. Furthermore, outer shell 60 has an internal surface 67 and an external surface 64. The external surface 64 of the outer shell 60 may include one or more access openings 43 and one or more secondary access openings 46. The internal surface 67 of the outer shell 60 can physically contact the outer surface 24 of the elastomeric sleeve 20, while grounding clamp 100 is operably attached to cable 10. For example, the outer shell 60 may generally surround, encompass, sheath, cover, accommodate, etc., the elastomeric sleeve 20. In another embodiment, the outer shell 60 is radially disposed over the elastomeric sleeve 20. In yet another embodiment, the elastomeric sleeve 20 is coaxially inserted into the generally axial opening of the outer shell 60. The outer shell 60 may be formed of conductive materials facilitating grounding through grounding clamp 100. Accordingly the outer shell 60 may be configured to extend an electromagnetic buffer by electrically contacting conductive surfaces of a conductive connector, such as a grounding lug, grounding bar or bus bar. In addition, the outer shell 60 may be formed of both conductive and non-conductive materials. For example the external surface 64 of the outer shell 60 may be formed of a polymer, while the remainder of the outer shell 60 may be comprised of a metal or other conductive material. The outer shell 60 may be formed of metals or polymers or other materials that would facilitate a shell body responsive to compression, either axial or radial compression. Manufacture of the outer shell 60 may include casting, extruding, cutting, knurling, turning, tapping, drilling, injection molding, blow molding, or other fabrication methods that may provide efficient production of the component.

The structural configuration of the outer shell 60 may vary accordingly to accommodate different functionality of the grounding clamp 100. In one embodiment, outer shell 60 may comprise a first split shell portion 63 and a second split shell portion 65, wherein the first split shell portion 63 and the second split shell portion 65 may securably join together to form a generally annular or cylindrical member, such as outer shell 60. For example, outer shell 60 may be formed by two halves unified, joined together, linked, coupled, combined, merged, etc., by a securing and/or tightening means, such as a fastener member 40 driven through a portion of the first split shell portion 63 and a portion of the second split shell portion 65 to securably join the two halves. Other securing and/or tightening means may include a strap or latching means to compress the first split shell portion 63 and the second split shell portion 65. First split shell portion 63 and second split shell portion 65 individually may have a cross-section generally consistent with a semicircle, crescent, semi-annular, curvilinear, arc, and the like, wherein the shape and cross-sections of the first and second split shell portions 63, 65 are substantially identical to form a generally cylindrical member, such as outer shell 60.

Furthermore, the outer shell 60 may include a means to secure the grounding clamp 100 to a structural element on the tower. For example, the outer shell 60 may include some structural element that facilitates attachment to a structural element on the tower. In one embodiment, the base or general frame of the outer shell 60 may include openings, holes, threaded bolt holes, bores, threaded bolt studs, or slots through which a fastening member may pass to secure the grounding clamp 100 to the tower or a structural element of the tower. In another embodiment, a strap may encircle the grounding clamp 100 around the outer shell 60 or partially around the outer shell 60 and through openings, holes, etc. located on the outer shell. The strap may have a fastening device suitable for tightening (i.e. reducing diameter of strap to provide radial compression). Thus, the grounding clamp 100 may be structured to provide physical support to the cable, in addition to grounding the cable at various points along the cable 10.

Figure 3:
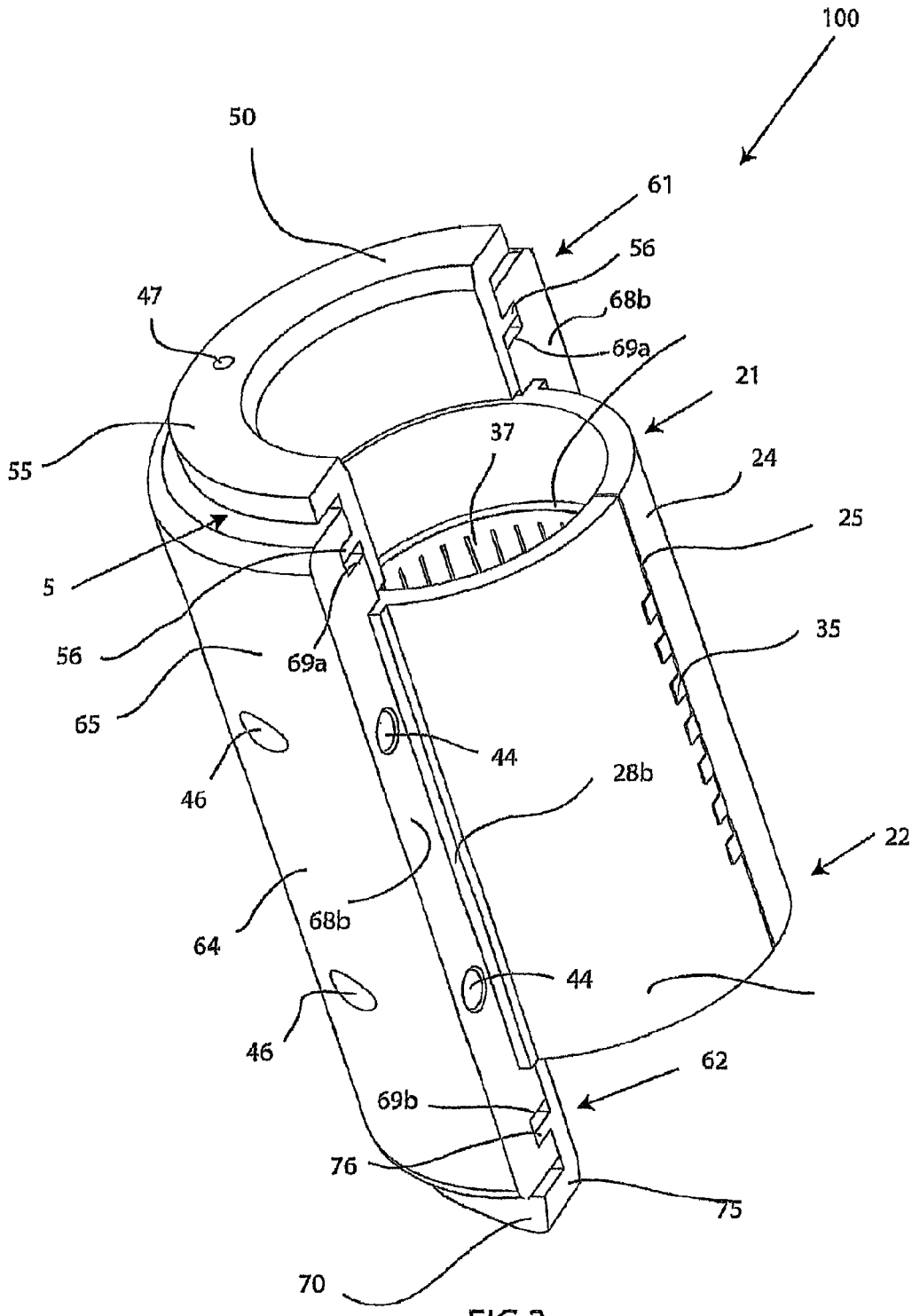
FIG. 3 depicts a perspective cut-away view of a first embodiment of a grounding clamp.
Figure 3A:
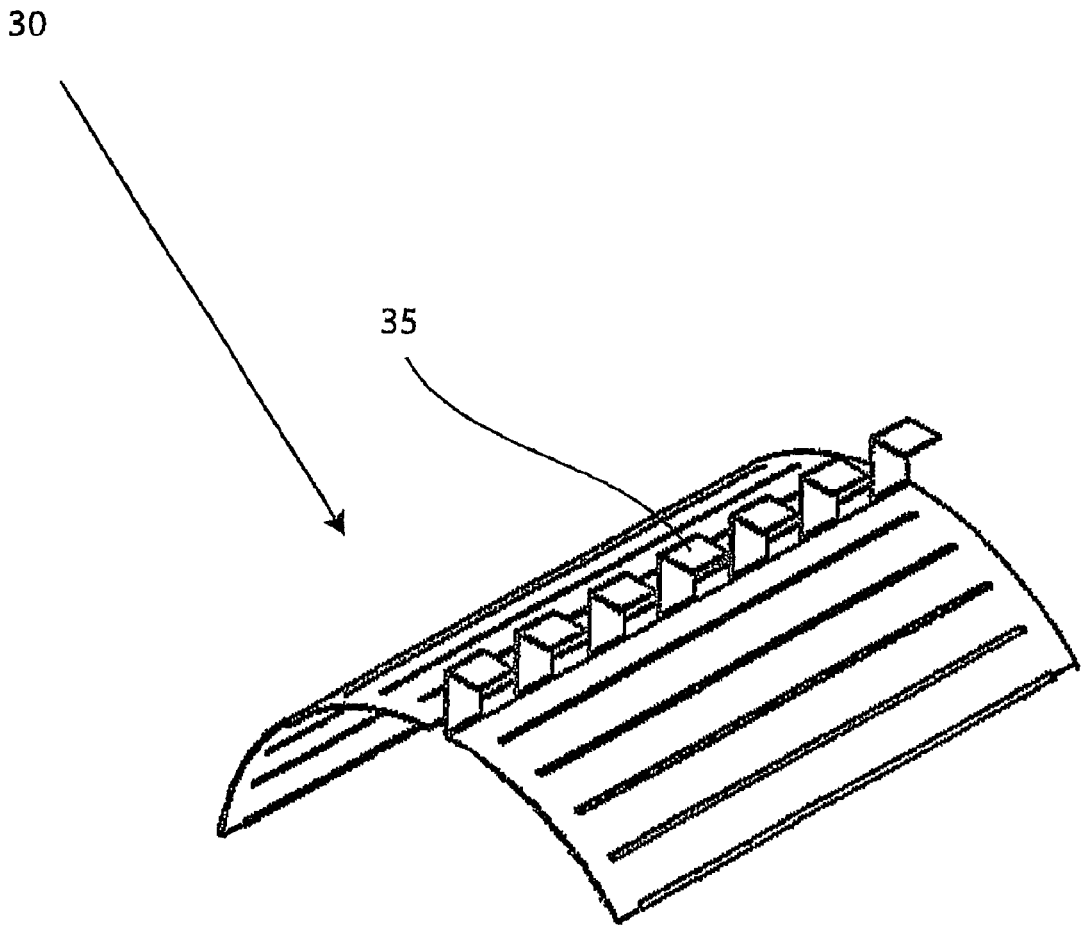

Referring now to FIG. 3, the first split shell portion 63 may comprise substantially planar contact surfaces 68*a* configured to make contact with contact surfaces 68*b* of the second split shell portion 65. Dual contact surfaces 68*a* may be coplanar surfaces axially extending from the first end 61 to the second end 62. The contact surfaces 68*a* may have a width from proximate or otherwise near the external surface 64 to proximate or otherwise near the internal surface 67. The contact surfaces 68*a* may abut, contact, interact, or adjoin with substantially similar and aligned contact surfaces 68*b* of the second split shell portion 65. For example, the first split shell portion 63 may be correspondingly placed on top of the second split shell portion 65, wherein contact surfaces 68*a* of the first split shell portion 63 substantially align with the contact surfaces 68*b* of the second split shell portion 65 to form a generally cylindrical shell, such as outer shell 60. Somewhere along the contact surfaces 68*a* may be one or more openings that allow a fastening member 40, such as a tightening bolt to pass through into an aligned bore 44 located on contact surfaces 68*b* of the second split shell portion 65. For example, contact surface 68*a* may include two openings spaced apart a distance to allow insertion of a fastening member 40 into an aligned bore 44 located on contact surface 68*b*. Moreover, the first split shell portion 63 may include one or more access opening(s) 43 located on the external surface 64 of the first split shell portion 63, wherein the access opening 43 provides adequate clearance for the placement and insertion of a fastening member 40 through openings on the contact surfaces 68*a* into an aligned bore 44 on contact surfaces 68*b* of the second split shell portion 65. Access opening(s) 43 may be a cavity, pocket, space, crater, void, and the like that provides clearance to access the fastening member 40 during installation of the grounding clamp 100. Access opening(s) 43 may have various shapes and dimensions to accommodate the manipulation and/or execution of various fastening means, such as the loosening and tightening of a fastening member 40, such as a tightening bolt, into bore 44.

Furthermore, the first split shell portion 63 may include a first inner groove 69*a* positioned proximate or otherwise near the first end 61 of the first split shell portion 63. The first inner groove 69*a* may be a groove, detent, cavity, void, tunnel, channel, keyway, and the like. The first inner groove 69*a* may be semi-annular and may open up towards the internal surface 67 of the first split shell portion 63. The first inner groove 69*a* may accommodate, accept, receive, and/or engage an outer annular rib 56 of the first split compression driver 50 while operably configured in both a closed position 4 and an open position 5. In many embodiments, the dimensions of the first inner groove 69*a* may be slightly larger to allow movement, in particular, axial movement of the outer annular rib 56 and the first split compression driver 50. Moreover, the first split shell portion 63 may include a second inner groove 69*b* positioned proximate or otherwise near the second end 62 of the first split shell portion 63. The second inner groove 69*b* may be a groove, detent, cavity, void, tunnel, channel, keyway, and the like. The second inner groove 69*b* may be semi-annular and may open up towards the internal surface 67 of the first split shell portion 63. The second inner groove 69*b* may accommodate, accept, receive, and/or engage an outer annular rib 76 of the second split compression driver 70 while operably configured in both a closed position 4 and an open position 5. In many embodiments, the dimensions of the second inner groove 69*b* may be slightly larger to allow movement, in particular, axial movement of the outer annular rib 76 and the second split compression driver 70.

Referring still to FIG. 3, the second split shell portion 65 may include substantially planar contact surfaces 68*b* configured to make contact with contact surfaces 68*a* of the first split shell portion 63. Dual contact surfaces 68*b* may be coplanar surfaces axially extending from the first end 61 to the second end 62. Contact surfaces 68*b* are substantially similar to contact surfaces 68*a* of the first split shell portion 63; however, each of the contact surfaces 68*b* of the second split shell portion 65 may also include an axially extending recessed edge 66 proximate or otherwise near an inner diameter of the outer shell 60. The recessed edge 66 may be a shelf, lateral detent, recessed surface, and the like, that is positioned a distance below the surface of contact surface 68*b*. The one or more recessed edges 66 may accommodate protrusions 28*a* and 28*b* of the elastomeric sleeve 20 when the first split shell portion 63 and the second split shell portion 65 are securably joined together to form outer shell 60. In embodiments where the elastomeric sleeve 20 does not include protrusions 28*a*, 28*b*, contact surfaces 68*b* may not include recessed edge 66. Those skilled in the art should appreciate that one embodiment of grounding clamp 100 may call for the first split shell portion 63 to include a recessed edge 66 to accommodate protrusions 28*a*, 28*b* of the elastomeric sleeve 20, instead of, or in addition to, the second split shell portion 65 including a recessed edge 66.

Somewhere along the surface of contact surfaces 68*b* may be one or more bores 44 to accommodate, accept, receive, etc., a fastening member 40, such as tightening bolt. For example, there may be one or more bores 44 spaced apart a distance on the surface of contact surfaces 68*b*, wherein the location of the bore 44 corresponds to the location of the openings located on contact surfaces 68*a* of the first split shell portion 63 to facilitate insertion of a fastening member 40 to securably join the first split shell portion 63 and the second split shell portion 65. Bore 44 may be an opening, hole, void, cavity, tunnel, channel, and the like, and may have a threaded or non-threaded inner surface to accommodate various fastening members 40, such as screws, bolts, or any fastening member known to those having skill in the art. Furthermore, the second split shell portion 65 may include one or more secondary access openings 46 located on the external surface 64 of the second split shell portion 65, wherein the location of the secondary access opening(s) 46 is aligned with the location of bore 44. The secondary access opening(s) 46 provides adequate clearance for the placement, tightening, and/or potential insertion of a fastening member 40 through an aligned bore 44. Secondary access opening(s) 46 may be a cavity, pocket, space, crater, void, and the like that provides clearance to access the fastening member 40 during installation of the grounding clamp 100. For example, a portion of the fastening member 40 may extend out from the second split shell portion 65 to allow the placement of securing means, such as a nut, washer, and the like. Access opening(s) may have various shapes and dimensions to accommodate the manipulation and/or execution of various fastening means, such as the loosening and tightening of a fastening member 40 into bore 44. Those skilled in the art should appreciate that one embodiment of grounding clamp 100 may call for the first split shell portion 63 to include one or more bores 44 to accept one or more fastening member 40 instead of, or in addition to, the second split shell portion 65 including one or more bores 44.

Furthermore, the second split shell portion 65 may include a first inner groove 69*c* positioned proximate or otherwise near the first end 61 of the second split shell portion 65. The first inner groove 69*c* may be a groove, detent, cavity, void, tunnel, channel, keyway, and the like. The first inner groove 69*c* may be semi-annular and may open up towards the internal surface 67 of the second split shell portion 65. The first inner groove 69*c* may accommodate, accept, receive, and/or engage an outer annular rib 56 of the first split compression driver 50 while operably configured in both a closed position 4 and an open position 5. In many embodiments, the dimensions of the first inner groove 69*c* may be slightly larger to allow movement, in particular, axial movement of the outer annular rib 56 and the first split compression driver 50. Moreover, the second split shell portion 65 may include a second inner groove 69*d* positioned proximate or otherwise near the second end 62 of the second split shell portion 65. The second inner groove 69*d* may be a groove, detent, cavity, void, tunnel, channel, keyway, and the like. The second inner groove 69*d* may be semi-annular and may open up towards the internal surface 67 of the second split shell portion 65. The second inner groove 69*d* may accommodate, accept, receive, and/or engage an outer annular rib 76 of the second split compression driver 70 while operably configured in both a closed position 4 and an open position 5. In many embodiments, the dimensions of the second inner groove 69*d* may be slightly larger to allow movement, in particular, axial movement of the outer annular rib 76 and the second split compression driver 70.

The first inner grooves 69*a*, 69*c* of the first and second split shell portions 63, 65, respectively, complete a full inner annular groove extending 360° around the internal surface 67 of the outer shell 60 proximate the first end 61 when the first and second split shell portions 63, 65 are securably joined to form outer shell 60. For instance, both first inner grooves 69*a*, 69*c* are substantially located in the same position proximate or otherwise near the first end 61 of the outer shell 60. Additionally, the second inner grooves 69*b*, 69*d* of the first and second split shell portions 63, 65, respectively, complete a full inner annular groove extending 360° around the internal surface 67 of the outer shell 60 proximate the second end 62 when the first and second split shell portions 63, 65 are securably joined to form outer shell 60. For instance, both second inner grooves 69*b*, 69*d* are substantially located in the same position proximate or otherwise near the first end 61 of the outer shell.

Referring still to FIG. 3, an embodiment of a grounding clamp 100 may include an elastomeric sleeve 20 configured for coaxial insertion into the outer shell 60. In other words, the elastomeric sleeve 20 may be disposed within the outer shell 60, or disposed within the first split shell portion 63 and second split shell portion 65. The elastomeric sleeve 20 comprises a first end 21 and opposing second end 22, and may be radially disposed over a prepared coaxial cable 10 and conductive bonding contact 30. For example, the elastomeric sleeve 20 may be configured to encircle or substantially surround a coaxial cable 10 and the conductive bonding contact 30. Elastomeric sleeve 20 may include one or more protrusions 28*a*, 28*b*, a slit 25, and one or more internal surface features 26. The elastomeric sleeve 20 is a generally annular member, having an outer diameter slightly smaller than the inner diameter of the outer shell 60. The slightly smaller outer diameter of the sleeve 20 allows the sleeve 20 to fit within the outer shell 60. Furthermore, the elastomeric sleeve 20 comprises an internal surface 27 and an external surface 24. In many embodiments, the external surface 24 of the elastomeric sleeve 20 may physically contact the internal surface 67 of the outer shell 60, and a middle portion of the internal surface 27 may contact the external surface 34 of the conductive bonding contact 30, while the outer portions of the internal surface 27 of the elastomeric sleeve 20 may contact an outer surface of the coaxial cable 10. In other words, the elastomeric sleeve 20 may share a radial relationship with the outer shell 60, conductive bonding contact 30, and the coaxial cable 10. For example, the elastomeric sleeve 20 may generally or substantially surround, encircle, wrap around, encompass, sheath, cover, accommodate, etc., the conductive bonding contact 30 and the cable 10. Prior to compression of the grounding clamp 100, there may be a permissible range of slight variation in the dimensions of the outer shell 60, the elastomeric sleeve 20, and conductive bonding contact 30. In particular, a slight radial tolerance may exist between the components of the grounding clamp 100 prior to compression of the grounding clamp 100.

Furthermore, an embodiment of the elastomeric sleeve 20 may include at least one surface feature 26, such as an annular detent, groove, bump, ridge, or lip that may engage an outer jacket edge 12*a*, 12*b* to prevent or hinder axial movement of the grounding clamp 100 relative to the coaxial cable 10 when in a final position over a prepared portion of the coaxial cable 10. In some embodiments, two internal surface features 26*a*, 26*b* may be positioned on the internal surface 27 of the elastomeric sleeve. Additionally, the elastomeric sleeve 20 may include one or more protrusions 28*a*, 28*b* that axially extend from the first end 21 to the second end 22 of the sleeve 20. Protrusions 28*a*, 28*b* may be any lip, ridge, bump, or protrusion that protrudes a distance away from the external surface 24 of the sleeve 20, and may have various cross-sections, such as circular, curvilinear, rectangular, or any polygonal shape. Protrusions 28*a*, 28*b*, may be located on the external surface 24 of the sleeve an equal circumferential distance away from slit 25, and may reside contiguous with recessed edge 66 of the outer shell 60, in particular, the second split shell portion 65. Protrusions 28*a*, 28*b* may facilitate proper placement of the components, facilitate proper engagement with the first and second split shell portions 63, 65, such as hindering unwanted movement after installation, and provide an additional, internal seal within the grounding clamp 100. Moreover, the elastomeric sleeve 20 should be formed of an elastic polymer, such as rubber, or any resilient material responsive to radial compression and/or deformation. Manufacture of the elastomeric sleeve 20 may include casting, extruding, cutting, turning, drilling, knurling, injection molding, spraying, blow molding, component overmolding, or other fabrication methods that may provide efficient production of the component.

Moreover, sleeve 20 includes a slit 25 that can allow a portion of a conductive bridge member 35 to pass through the sleeve 20 to electrically contact the internal surface 67 of the outer shell 60. Slit 25 may be a slit, slot, opening, or aperture between two portions of the sleeve 20. In one embodiment, slit 25 may be formed by an abutment of two edges of a curved piece of elastomeric material, such as elastomeric sleeve 20. Alternatively, slit 25 may be formed by cutting, slicing, scoring, piercing, etc. a whole, one-piece elastomeric sleeve 20 in an axial direction along from a first end 21 to a second end 22. During installation, the resilient elastomeric sleeve 20 may be spread open because of the slit 25 and then subsequently radially disposed over the conductive bonding contact 30 and coaxial cable 10. Because the elastomeric sleeve 20 is resilient, it will regain a generally annular or cylindrical shape and encompass the conductive bonding contact 30 and the cable 10. When the elastomeric sleeve 20 is disposed over the conductive bonding contact 30, the conductive bridge member 35 (e.g. plurality of conductive tabs) should emerge, pass through, poke through, protrude, extend, etc., through the slit 25 such that the conductive bridge member 35 is exposed and may contact the internal surface 67 of the outer shell 60. Thus, a folded portion of the of the protruding portions of the conductive bridge member 35 rests on the external surface 24 of the elastomeric sleeve 20, in position to contact the internal surface 67 of the outer shell. In other words, prior to axial compression of the grounding clamp 100 components, the conductive bridge member 35 may contact the internal surface 67 of the outer shell 60. After the grounding clamp 100 is compressably affixed to the coaxial cable 10 over the exposed conductive portion of the coaxial cable 10, the conductive bridge member 35 should constantly contact the outer shell 60 through the slit 25 of the elastomeric sleeve 20 due to the compressive forces. Alternatively, the elastomeric sleeve 20 may be slid along the cable 10 to a final position, provided one end of the cable is free (i.e. not lashed to a tower). Those having ordinary skill in the art should appreciate that other means may be used to allow a portion of the conductive bonding contact 30 to contact the outer shell 60.

Referring again to FIG. 3, an embodiment of a grounding clamp 100 may also include a conductive bonding contact 30, the conductive bonding contact 30 being a generally annular member, having a fist end 31 and an opposing second end 32. The conductive bonding contact 30 can be sized for coaxial insertion within the elastomeric sleeve 20. For example, the conductive bonding contact 30 may encircle or substantially surround the prepared coaxial cable 10. In one embodiment, the conductive bonding contact 30 only wraps around the exposed conductive portion of the prepared coaxial cable 10, such as the conductive grounding shield 14 or dielectric foil layer 15. In another embodiment, the conductive bonding contact 30 may encircle or substantially surround both the exposed conductive portion of the coaxial cable 10 and a portion of the remaining (i.e. unremoved) outer jacket 12 on either side of the conductive bonding contact 30. Additionally, the conductive bonding contact 30 may share a radial relationship with the elastomeric sleeve 20, the cable 10 and the outer shell 60, wherein the conductive bonding contact 30 is radially disposed within the elastomeric sleeve 20 and outer shell 60. The conductive bonding contact 30 has an external surface 34 and an internal surface 37, wherein the external surface 34 contacts the internal surface 27 of the elastomeric sleeve 20, and the internal surface 37 contacts an outer surface of a prepared coaxial cable 10, such as conductive grounding shield 14 or dielectric foil layer 15.

Further still, the conductive bonding contact 30 may include a conductive bridge member 35 axially positioned on the external surface 34 of the conductive bonding contact 30. While operably configured, the location of the conductive bridge member 35 should correspond to the location of the slit 25 of the elastomeric sleeve 20 to allow the bridge member 35 to pass through the slit 25 with the least possible interference. For instance, the conductive bridge member 35 should be substantially underneath the slit 25 of the elastomeric sleeve 20 to facilitate electrical continuity between the conductive bonding contact 30 and the outer shell 60. The conductive bridge member 35 may comprise one or more protruding members, such as tabs, hooks, L-shaped members, sharing a linear relationship with each other. The conductive bridge member 35 and its components should be made of the same conductive material as the conductive bonding contact 30. The conductive bonding contact 30 should be a formed of a conductive material, such as a metal, or similar materials sharing similar conductive properties. Moreover, conductive bonding contact 30 may be resilient, pliable, flexible, and the like. Alternatively, the conductive bonding contact 30 may be a rigid or semi-rigid structure that deforms when subject to compressive forces. The conductive bonding contact 30 may be a member, element, and/or structure that contacts the outer conductive portion of the coaxial cable 10 while also contacting the outer shell 60 of the grounding clamp 100, thereby establishing and maintaining physical and electrical contact between them. Optional openings, or slots, may be located on the body of the conductive bonding contact 30. Manufacture of the conductive bonding contact 30 may include casting, extruding, cutting, turning, drilling, drilling, compression molding, injection molding, spraying, or other fabrication methods that may provide efficient production of the component.

With further reference to FIG. 3, embodiments of a split compression mid-span grounding clamp, such as grounding clamp 100, may also include a first split compression driver 50 moveably attached to the outer shell 60, wherein a portion of the first split compression driver 50 is radially disposed over a coaxial cable 10. For example, the second split compression driver 50 may be moveably attached to the first end 61 of the outer shell 60, such that when in an open position 5 (embodied by FIG. 1) the first split compression driver 50 is free to move but not detach, and when in a closed position 4 (embodied by FIG. 4) the first split compression driver 50 moves axially in a press-fit or similarly tight engagement with the outer shell 60 proximate or otherwise near the first end 61, actuated by a means of axial compression. The means of axial compression may be a compression tool to axially compress the first split compression driver 50 into a press-fit engagement with the outer shell 60. In most embodiments, the press-fit or similarly tight engagement should be sufficient to prevent loosening of the components; however, additional compression means may be used to further prevent independent and/or unwanted loosening. For example, on or more fastening members, similar to fastening member 40, may be axially inserted into one or more bores 47 located on the outer annular flange 55 to axially compress the first split compression driver 50 into engagement with the outer shell 60 and keep the first split compression driver 50 in a closed position 4, and also help prevent binding or independent movement of the first split compression driver 50. Furthermore, the first split compression member 50 may comprise a first end 51 and opposing second end 52, an outer annular flange 55, and an outer annular rib 56. Outer annular flange 55 may be located a distance above the outer annular rib 56, both components being an annular lip, shelf, edge, protrusion, bump, and the like, having various cross-sections, including rectangular, curvilinear, or generally polygonal. Outer annular flange 55 may configured to contact or engage an axial compression device, such as a compression tool. Outer annular rib 56 may be positioned within the first inner grooves 69*a*, 69*c* proximate the first end 61 of the outer shell 60. Moreover, outer annular rib 56 may prevent the first compression driver 50 from detaching from the outer shell 60 when moved, rotated, tilted, etc., because of its inevitable engagement with the walls of the first inner grooves 69*a*, 69*c*.

The first split compression member 50 may be a generally annular member formed by two substantially identical shell portions, such as first split compression shell 58 and second split compression shell 59. First and second split compression shells 58, 59 may be unified, joined together, linked, coupled, combined, merged, etc., to form first split compression member 50. First split compression shell 58 and second split compression shell 59 individually may have a cross-section generally consistent with a semicircle, crescent, (i.e. semi-annular), curvilinear, arc, and the like, wherein the shape and cross-sections of the first and second split compression shells 58, 59 are substantially identical to form a generally cylindrical member, such as first split compression member 50. First split compression shell 58 may include an outer flange 55*a* proximate or otherwise near the first end 51 and an outer rib 56*a* proximate or otherwise near the second end 52. Outer rib 56*a* and outer flange 55*a* may be a semi-annular lip, shelf, edge, rib, protrusion, bump, and the like. Second split compression shell 59 may include an outer flange 55*b* proximate or otherwise near the first end 51 and an outer rib 56*b* proximate or otherwise near the second end 52. Outer rib 56*b* and outer flange 55*ab* may be a semi-annular lip, shelf, edge, rib, protrusion, bump, and the like. The joining of first and second compressions shells 58, 59 complete outer annular flange 55 and outer annular rib 56 described supra.

Moreover, a portion of the first split compression driver 50 may be inserted into the outer shell 60 proximate the first end 61, wherein the outer annular rib 56 engages the inner grooves 69*a*, 69*c*. For example, the external surface 54 may physically contact the internal surface 67 of the outer shell proximate the first end 61, while the outer annular flange 55 may remain exposed (i.e. not in contact with the internal surface 67 of the outer shell 60). The first split compression driver 50 may be operably inserted into the first end 61 of the outer shell 60 and axially compressed into an closed position 4 from an open position 5, wherein the axial compression is generated by various means, such as a compression tool keyed for applying axial compression. The compression fit, press-fit, or similarly tight engagement between the first split compression driver 50 proximate or otherwise near the first end 61 of the outer shell 60 effectively seals the first end 1 of grounding clamp 100 and protects the grounding clamp 100 from corrosion and/or environmental pollutants, such as rain water and moisture which may migrate along the cable 10. The first split compression driver 50 may also have a groove in it for an O-ring that can help assist in sealing the ends of a grounding clamp 100. For example, an annular recess or annular detent may be positioned on the inner surface of the first split compression shell 58 and second split compression shell 59 to accommodate a resilient O-ring, or similar annular member. Furthermore, the first split compression driver 50 may be formed of conductive or non-conductive materials or a combination thereof. Manufacture of the first split compression driver 50 may include casting, extruding, cutting, turning, drilling, knurling, injection molding, spraying, blow molding, component overmolding, combinations thereof, or other fabrication methods that may provide efficient production of the component.

Referring still to FIG. 3, embodiments of a split compression mid-span grounding clamp, such as grounding clamp 100, may also include a second split compression driver 70 moveably attached to the outer shell 60, wherein a portion of the second split compression driver 70 is radially disposed over a coaxial cable 10. For example, the second split compression driver 70 may be moveably attached to the second end 62 of the outer shell 60, such that when in an open position 5 (embodied by FIG. 1) the second split compression driver 70 is free to move but not detach, and when in a closed position 4 (embodied by FIG. 4) the second split compression driver 70 moves axially in a press-fit or similarly tight engagement with the outer shell 60 proximate or otherwise near the second end 62, actuated by a means of axial compression. The means of axial compression may be a compression tool to axially compress the second split compression driver 70 into a press-fit engagement with the outer shell 60. In most embodiments, the press-fit or similarly tight engagement should be sufficient to prevent loosening of the components; however, additional compression means may be used to further prevent independent and/or unwanted loosening. For example, one or more fastening members, similar to fastening member 40, may be axially inserted into one or more bores 47 located on the outer annular flange 75 to axially compress the second split compression driver 70 into engagement with the outer shell 60 and keep the second split compression driver 70 in a closed position 4, and also help prevent binding or independent movement of the second split compression driver 70. Furthermore, the second split compression driver 70 may comprise a first end 71 and opposing second end 72, an outer annular flange 75, and an outer annular rib 76. Outer annular flange 75 may be located a distance above the outer annular rib 76, both components being an annular lip, shelf, edge, protrusion, bump, and the like, having various cross-sections, including rectangular, curvilinear, or generally polygonal. Outer annular flange 75 may be configured to contact or engage an axial compression device, such as a compression tool. Outer annular rib 76 may be positioned within the second inner grooves 69*b*, 69*d* proximate the second end 62 of the outer shell 60. Moreover, outer annular rib 76 may prevent the second compression driver 70 from detaching from the outer shell 60 when moved, rotated, tilted, etc., because of its inevitable engagement with the walls of the second inner grooves 69*b*, 69*d*.

The second split compression driver 70 may be a generally annular member formed by two substantially identical shell portions, such as first split compression shell 78 and second split compression shell 79. First and second split compression shells 78, 79 may be unified, joined together, linked, coupled, combined, merged, etc., to form second split compression driver 70. First split compression shell 78 and second split compression shell 79 individually may have a cross-section generally consistent with a semicircle, crescent, (i.e. semi-annular), curvilinear, arc, and the like, wherein the shape and cross-sections of the first and second split compression shells 78, 79 are substantially identical to form a generally cylindrical member, such as second split compression driver 70. First split compression shell 78 may include an outer flange 75*a* proximate or otherwise near the first end 71 and an outer rib 76*a* proximate or otherwise near the second end 72. Outer rib 76*a* and outer flange 75*a* may be a semi-annular lip, shelf, edge, rib, protrusion, bump, and the like. Second split compression shell 79 may include an outer flange 75*b* proximate or otherwise near the first end 71 and an outer rib 76*b* proximate or otherwise near the second end 72. Outer rib 76*b* and outer flange 75*ab* may be a semi-annular lip, shelf, edge, rib, protrusion, bump, and the like. The joining of first and second compressions shells 78, 79 completes outer annular flange 75 and outer annular rib 76 described supra.

Moreover, a portion of the second split compression driver 70 may be inserted into the outer shell 60 proximate the second end 62, wherein the outer annular rib 76 engages the second inner grooves 69*b*, 69*b*. For example, the external surface 74 of the second split compression driver 70 may physically contact the internal surface 67 of the outer shell proximate the second end 62, while the outer annular flange 75 may remain exposed (i.e. not in contact with the internal surface 67 of the outer shell 60). The second split compression driver 70 may be operably inserted into the second end 62 of the outer shell 60 and axially compressed into an closed position 4 from an open position 5, wherein the axial compression is generated by various means, such as a compression tool keyed for applying axial compression. The compression fit, press-fit, or similarly tight engagement between the second split compression driver 70 proximate or otherwise near the second end 62 of the outer shell 60 effectively seals the second end 2 of grounding clamp 100 and protects the grounding clamp 100 from corrosion and/or environmental pollutants, such as rain water and moisture which may migrate along the cable 10. Furthermore, the second split compression driver 70 may be formed of conductive or non-conductive materials or a combination thereof. The second split compression driver 70 may also have a groove in it for an O-ring that can help assist in sealing the ends of the grounding clamp 100. For example, an annular recess or annular detent may be positioned on the inner surface of the first split compression shell 78 and second split compression shell 79 to accommodate a resilient O-ring, or similar annular member. Manufacture of the second split compression driver 70 may include casting, extruding, cutting, turning, drilling, knurling, injection molding, spraying, blow molding, component overmolding, combinations thereof, or other fabrication methods that may provide efficient production of the component.

Turning now to FIGS. 1-3, the manner in which the grounding clamp 100 may be operably affixed, attached, secured, closed, locked, sealed etc. to a prepared coaxial cable 10 involves radial compression or tightening of two shell portions 63, 65 through a fastening means. After a portion of the outer jacket 12 is removed to create a break and expose an outer conductive portion of the coaxial cable 10, the conductive bonding contact 30 and elastomeric sleeve 30 may be positioned over the break in a position where the internal surface feature(s) 26 mate with the outer edges 12*a*, 12*b* of the outer jacket 12 to stop or prevent further axial movement of the grounding clamp 100 along the cable 10 while operably configured. Next, the first and second split shell portion 63, 65 may be disposed over the elastomeric sleeve 20, such that contact surfaces 68*a* of the first split shell portion 63 correspondingly join contact surfaces 68*b* of the second split portion 65. Once the two shell portions 63, 65 form an outer shell, such as outer shell 60, one or more fastening members 40 may be inserted through both split shell portions 63, 65 to securably join the split shell portions 63, 65. The fastening member 40, or other securing means may compress the grounding clamp 100 around the prepared coaxial cable 10. Any device, method, or means for producing radially inward forces against the external surface 64 of the outer shell to compress the grounding clamp 100 may be used. In most embodiments, the tightening of a fastening member 40 compresses the elastomeric sleeve 20, wherein the compression of the elastomeric sleeve 20 drives the conductive bonding contact 30 into the exposed outer conductive portion of the coaxial cable 10. The radial compression of the grounding clamp 100, in particular, the radial compression of the elastomeric sleeve 20 and conductive bonding contact 30 results in the conductive bonding contact 30 conforming to the surface of the outer conductive portion of the cable 10 to establish and maintain physical and electrical continuity throughout the grounding clamp 100. For example, the fastening or securing means may radially compress the grounding clamp 100, forcing the conductive bonding contact 30 to mate with the stripped channel of the prepared coaxial cable 10. Furthermore, the radial compression of the grounding clamp 100 also facilitates the electrical contact between the conductive bonding contact 30 and the outer shell 60 via the physical contact between the conductive bridge member 35 and internal surface 67 of the outer shell 60. Additionally, the axial compression of the first and second split compression drivers 50, 70 effectively compress the elastomeric sleeve 20 and the conductive bonding contact 30 against the coaxial cable 10, wherein the axial compression of the first and second split compression drivers 50, 70 also effectively create annular seals at the first and second ends 1, 2 of the grounding clamp 100 to prevent ingress of environmental pollutants that may migrate along the cable 10. After the grounding clamp 100 is operably affixed to the coaxial cable 10, the grounding clamp 100 may then be connected to conductive connectors such as grounding wires via studs, band clamps, or bolting to a bus bar.

Alternatively, one of the first or second split compression drivers 50, 70 may not be moveable, while the other is compressed into an end of the grounding clamp 100. For example, the first split compression driver 50 may not be moveable (i.e. preassembled into position, stationary, or designed to fit within the diameter of the first end without the need for compression), while the second split compression driver 70 is axially compressed into the second end 62 of the outer shell 60. Thus, only one end of the grounding clamp 100 would require axial compression to securably affix the grounding clamp 100 to the cable 10. In another embodiment, the first and second split compression drivers 50, 70 may axially compress the ends of the grounding clamp 100 with the use of a torque wrench. The first and second split compression drivers 50, 70 may be dimensioned similar to a tire lug nut, and may be turned, rotated, wrenched, etc. to provide axial compression to the grounding clamp 100.

Figure 4:
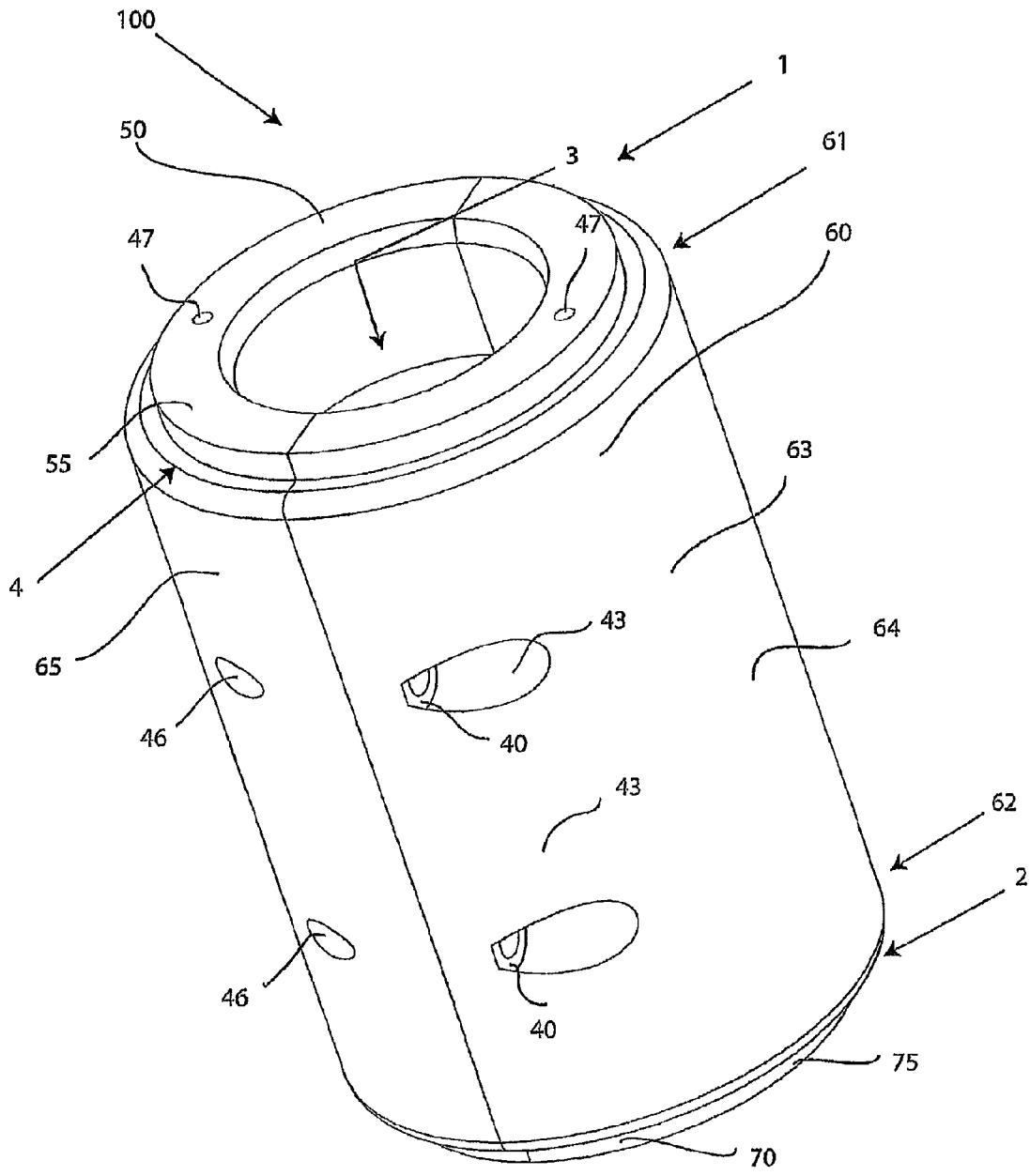
FIG. 4 depicts a perspective view of an embodiment of a grounding clamp in a closed position.

With reference to FIG. 4, an embodiment of grounding clamp 200 includes outer shell 260, elastomeric sleeve 220, conductive bonding contact 230, first split compression driver 250, and second split compression driver 270. Outer shell 260 includes first split shell portion 263 and second split shell portion 265, which securably join to form outer shell 260. Outer shell 260 carries the same structure and function as outer shell 60 described supra. Elastomeric sleeve 220 includes a plurality of sections 220*a*, 220*b*, and 220*c*, wherein an aligned slit 225 axially extends from a first end 221 to a second end 222 to allow installation over a coaxial cable 10. In one embodiment, elastomeric sleeve 220 may include three sections of equal size. In another embodiment, elastomeric sleeve 220 may include three sections, wherein the middle section is larger than two equal sized outer sections. Those skilled in the art should appreciate that the plurality of sections 220*a*, 220*b*, 220*c*, forming elastomeric sleeve 220 may include a plurality of sections having various sizes; however, the plurality of sections 220*a*, 220*b*, and 220*c* should substantially share the same diameter and thickness. Other structural features and functions described in conjunction with elastomeric sleeve 20 may also be present on elastomeric sleeve 220.

Disposed within elastomeric sleeve 220 can be conductive bonding contact 230, wherein a first conductive bridge member 235 is radially positioned proximate or otherwise near the first end 231 of the conductive bonding contact 230 and a second conductive bridge member 236 radially positioned proximate or otherwise near the second end 232 of the conductive bonding contact 230. The first and second conductive bridge members 235, 236 may include a plurality of protruding members, such as tabs, hooks, or L-shaped members, that should emerge, pass through, poke through, protrude, extend, etc., through the slit 225 such that the first and second conductive bridge members 235, 236 are exposed, and may contact the internal surface 67 of the outer shell 60. Thus, two sets of folded portions of the of the protruding portions of the conductive bridge member 35 rests on the external surface 24 of the elastomeric sleeve 20, in position to contact the internal surface 67 of the outer shell, as depicted in FIG. 5. In other words, prior to compression of the grounding clamp 100 components, the first and second conductive bridge members 23, 236 may contact the internal surface 67 of the outer shell 60.

Referring now to FIGS. 1-5, a method for maintaining ground continuity through a coaxial cable 10 may comprise the steps of providing a grounding clamp 100 having an outer shell 60, having a first end 61 and an opposing second end 62, the outer shell 60 including a first split shell portion 63 and a second split shell portion 65, the first split shell portion 63 and the second split shell portion 65 securely joinable to form the complete outer shell 60, wherein at least a portion of the outer shell 60 is conductive, an elastomeric sleeve 20, sized for coaxial insertion within the outer shell 60 between the first end 61 and the second end 62, the elastomeric sleeve 20 configured to encircle or substantially surround a prepared portion of a coaxial cable 10, a conductive bonding contact 30, sized for coaxial insertion within the elastomeric sleeve 20 and having a conductive bridge member 35 structured to make electrical contact with the outer shell 60, when the conductive bonding contact 30 is disposed within the outer shell 60, a first split compression driver 50, having two split portions that are joinable to form the complete first split compression driver 50, and a second split compression driver 70, having two split portions that are joinable to form the complete second split compression driver 70, and the step of axially compressing the first split compression driver 50 into the first end 61 of the outer shell 60 and the second split compression driver 70 into second end 62 of the outer shell 60, wherein the axial compression of the first split compression driver 50 and the second split compression driver 70 compresses the elastomeric sleeve 20, moving the conductive bonding contact 30 into contact with an outer conductor of the prepared coaxial cable 10 when the cable 10 is disposed within the grounding clamp device 100. The method may further include tightening together the first split shell portion 63 and the second split shell portion 65 to compress the grounding clamp 100 so that a grounding path extends between the outer conductor of the coaxial cable 10 through the at least one conductive tab 35 of the conductive bonding contact 30 of the outer shell 60, wherein the first split compression driver 50 and the second split compression driver 70 form annular seals around an outer jacket 12 of the coaxial cable 10 at the first and second ends 61, 62 of the outer shell 60, thereby effectively sealing the grounding clamp device 100 to the coaxial cable 10. Moreover, the method may involve the conductive bonding contact 30 conforming to the surface of the exposed outer conductive portion of the coaxial cable 10 when the grounding clamp 100 is compressed. The tightening of the first split shell portion 63 to the second split shell portion 65 may be accomplished by one or more fastening members 40, and the axial compression may be actuated by a compression tool.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A split compression mid-span coaxial cable grounding clamp device comprising:

an outer shell, having a first end and an opposing second end, the outer shell including a first split shell portion and a second split shell portion, the first split shell portion and the second split shell portion securely joinable to form the complete outer shell, wherein at least a portion of the outer shell is conductive;

an elastomeric sleeve, sized for coaxial insertion within the outer shell between the first end and the second end, the elastomeric sleeve configured to substantially surround a prepared portion of a coaxial cable;

a conductive bonding contact, sized for coaxial insertion within the elastomeric sleeve and having a conductive bridge member structured to make electrical contact with the outer shell, when the conductive bonding contact is disposed within the outer shell;

a first split compression driver, having two split portions that are joinable to form the complete first split compression driver; and a second split compression driver, having two split portions that are joinable to form the complete second split compression driver;

wherein, when the first split compression driver is compressed into the first end of the outer shell and the second split compression driver is compressed into second end of the outer shell, the elastomeric sleeve is compressed moving the conductive bonding contact into contact with an outer conductor of the prepared coaxial cable when the cable is disposed within the grounding clamp device, and the first split compression driver and the second split compression driver form annular seals around an outer jacket of the coaxial cable at the first and second ends of the outer shell, thereby effectively sealing the grounding clamp device to the coaxial cable.

2. The split compression mid-span coaxial cable grounding clamp device of claim 1, wherein the outer conductor of the prepared coaxial cable is a conductive grounding shield exposed by removing a portion of an outer jacket of the coaxial cable.

3. The split compression mid-span coaxial cable grounding clamp device of claim 1, wherein the outer conductor of the prepared coaxial cable is a foil layer exposed by removing a portion of an outer jacket and a portion of the conductive grounding shield of the coaxial cable.

4. The split compression mid-span coaxial cable grounding clamp device of claim 1, further comprising:

one or more access openings located on the external surface of the outer shell providing clearance to insert one or more fastening members through both the first split shell portion and the second split shell portion; and at least one protrusion member positioned on a side of the elastomeric sleeve to reside within a recessed edge positioned on the second split shell portion.

5. The split compression mid-span coaxial cable grounding clamp device of claim 1, wherein the first split shell portion and the second split shell portion join together at substantially aligned contact surfaces that extend from the first end to the opposing second end of the outer shell.

6. A grounding clamp comprising:

a first shell portion disposed over an elastomeric sleeve, the elastomeric sleeve having a slit extending therethrough;

a second shell portion disposed over the elastomeric sleeve, wherein the first shell portion and second shell portion securably join to form an outer shell, the outer shell having a first end, an opposing second end, and a first inner annular opening positioned proximate the first end and a second inner annular opening positioned proximate the second end of the outer shell;

a conductive member surrounded by the elastomeric sleeve, the conductive member surrounding an exposed outer conductive portion of a coaxial cable;

a first split compression driver moveably attached to the first end of the outer shell; and a second split compression driver moveably attached to the second end of the outer shell;

wherein tightening of the first shell portion to the second shell portion and axial compression of the first split compression driver and the second split compression driver drives the conductive member into contact with the exposed outer conductive portion of the coaxial cable to facilitate an adequate electrical grounding connection, and forms annular seals around the coaxial cable.

7. The grounding clamp of claim 6, further comprising:

a plurality of tabs located on an external surface of the conductive member contacting an internal surface of the outer shell through the slit of the elastomeric sleeve;

one or more access openings located on the external surface of the outer shell providing clearance to insert one or more fastening members through both the first shell portion and the second shell portion; and at least one protrusion member positioned on a side of the elastomeric sleeve to reside within a recessed edge positioned on the second shell portion.

8. The grounding clamp of claim 6, wherein at least a portion of the outer shell is conductive.

9. The grounding clamp of claim 6, wherein the wherein tightening of the first shell portion to the second shell portion causes the conductive member to conform to the surface of the outer conductive portion of a coaxial cable.

10. The grounding clamp of claim 6, wherein the first shell portion and the second shell portion join together at substantially aligned contact surfaces that extend from the first end to the second end of the outer shell.

11. The grounding clamp of claim 6, further comprising:

a first end outer annular protrusion positioned on an external surface of the first split compression driver, the first end outer annular protrusion configured to engage the first inner annular opening of the outer shell; and a second end outer annular protrusion positioned on an external surface of the second split compression driver, the second end outer annular protrusion configured to engage the second inner annular opening of the outer shell.

12. A device comprising:

a grounding clamp positioned on a coaxial cable at a location other than an end of the coaxial cable, wherein the grounding clamp includes an outer shell formed by the unity of a first split shell portion and a second split shell portion, the outer shell having a radial relationship with an elastomeric sleeve, the elastomeric sleeve being radially disposed over a conductive bonding contact, the conductive bonding contact being radially disposed over an outer conductive portion of the coaxial cable;

wherein axial compression of a first split driver and a second split driver against the ends of the grounding clamp facilitates electrical contact between the outer shell and the conductive bonding contact and between the conductive bonding contact and the outer conductive portion of the coaxial cable.

13. The device of claim 12, wherein the outer conductive portion of the coaxial cable is a conductive grounding shield exposed by removing a portion of an outer jacket of the coaxial cable.

14. The device of claim 12, wherein the outer conductive portion of the coaxial cable is a foil layer exposed by removing a portion of an outer jacket and a portion of the conductive grounding shield of the coaxial cable.

15. The device of claim 12, further comprising:

a conductive bridge member positioned axially along an external surface of the conductive bonding contact; and an opening positioned axially along the elastomeric sleeve, wherein the conductive bridge member contacts an internal surface of the outer shell through the opening of the elastomeric sleeve;

wherein the conductive bridge member is axially aligned with the opening of the elastomeric sleeve.

16. The device of claim 12, wherein the axial compression is actuated by a compression tool.

17. The device of claim 12, wherein the fastening mechanism includes tightening a fastening member through a portion of the first split shell portion and a portion of the second split shell portion.

18. The device of claim 12, wherein the fastening mechanism includes a strap that latches around the outer shell to tighten the first split shell portion to the second split shell portion.

* * * * *

UNITED STATES PATENT AND TRADEMARK OFFICE

CERTIFICATE OF CORRECTION

PATENT NO. : 8,152,559 B1
APPLICATION NO. : 13/076886
DATED : April 10, 2012
INVENTOR(S) : Noah Montena It is certified that error appears in the above-identified patent and that said Letters Patent is hereby corrected as shown below:

Claim 20. Line 3, after "wherein the" delete -- wherein --

Signed and Sealed this
Fifth Day of June, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,152,559 B1
APPLICATION NO. : 13/076886
DATED : April 10, 2012
INVENTOR(S) : Noah Montena It is certified that error appears in the above-identified patent and that said Letters Patent is hereby corrected as shown below:

Column 20, Line 3 (Claim 9, Line 1) after "wherein the" delete -- wherein --

This certificate supersedes the Certificate of Correction issued June 5, 2012.

Signed and Sealed this
Third Day of July, 2012

David J. Kappos

David J. Kappos
*Director of the United States Patent and Trademark Office*